US008615178B2

(12) United States Patent
Mochizuki

(10) Patent No.: US 8,615,178 B2
(45) Date of Patent: Dec. 24, 2013

(54) IMAGE FORMING APPARATUS WITH VOLTAGE APPLICATION OR ELECTRIC FIELD FORMATION DURING ROTATION START OR STOP

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 810 days.

(21) Appl. No.: 11/956,846

(22) Filed: Dec. 14, 2007

(65) Prior Publication Data

US 2008/0145076 A1 Jun. 19, 2008

(30) Foreign Application Priority Data

Dec. 19, 2006 (JP) ..... 2006-341903

(51) Int. Cl.
*G03G 15/16* (2006.01)

(52) U.S. Cl.
USPC ..... 399/66

(58) Field of Classification Search
USPC ..... 399/66
See application file for complete search history.

(56) References Cited

U.S. PATENT DOCUMENTS

| | | | | |
|---|---|---|---|---|
| 5,572,305 | A * | 11/1996 | Hayashi et al. | 399/121 |
| 5,602,578 | A | 2/1997 | Sumiyoshi et al. | |
| 6,421,521 | B2 | 7/2002 | Tanaka | |
| 6,597,886 | B1 * | 7/2003 | Yoshida | 399/302 |
| 6,600,894 | B2 | 7/2003 | Takahashi et al. | |
| 6,904,245 | B2 | 6/2005 | Mochizuki et al. | |
| 6,990,300 | B2 | 1/2006 | Saito et al. | |
| 7,327,966 | B2 | 2/2008 | Watanabe | |
| 7,343,109 | B2 * | 3/2008 | Nishimura | 399/43 |
| 7,555,236 | B2 * | 6/2009 | Saeki | 399/101 |
| 2001/0031160 | A1 | 10/2001 | Tanaka | |
| 2006/0024073 | A1 * | 2/2006 | Murakami et al. | 399/44 |
| 2006/0204263 | A1 * | 9/2006 | Watanabe | 399/66 |

FOREIGN PATENT DOCUMENTS

| | | | | |
|---|---|---|---|---|
| JP | 05-281819 | A | 10/1993 | |
| JP | 06-258897 | A | 9/1994 | |
| JP | 08-95339 | A | 4/1996 | |
| JP | 09-160324 | A | 6/1997 | |
| JP | 09160324 | A * | 6/1997 | G03G 15/00 |
| JP | 11-65333 | A | 3/1999 | |
| JP | 2001-255761 | A | 9/2001 | |
| JP | 2001-282015 | A | 10/2001 | |
| JP | 2002-169385 | A | 6/2002 | |
| JP | 2002-351230 | A | 12/2002 | |
| JP | 2003-241536 | A | 8/2003 | |
| JP | 2006-242992 | A | 9/2006 | |

OTHER PUBLICATIONS

Notification of Reason for Refusal dated Apr. 3, 2012, in Japanese Application No. 2006-341903.

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image forming apparatus is constituted by an image carrying member movable while carrying a toner image, or a recording material carrying member movable while carrying a recording material onto which a toner image is to be transferred; a contact member movable while contacting the image carrying member or the recording material carrying member; and a voltage adjusting member for adjusting a voltage to be applied to the contact member so that an absolute value of the voltage when a state of the image carrying member or the recording material carrying member and the contact member is changed from a rest state in which these members are resting to a moving state in which these members are moving is larger than an absolute value of the voltage in the rest state.

24 Claims, 7 Drawing Sheets

REPLACEMENT SHEET

IMAGE FORMING APPARATUS WITH VOLTAGE APPLICATION OR ELECTRIC FIELD FORMATION DURING ROTATION START OR STOP

FIELD OF THE INVENTION AND RELATED ART

The present invention relates to an image forming apparatus for transferring a toner image from a photosensitive drum or the like onto an intermediary transfer belt or the like. More specifically, the present invention relates to control for alleviating rubbing damage of the photosensitive drum or the like occurring during starting by a simple method.

A full-color image forming apparatus in which a plurality of photosensitive drums different in developing color is disposed along a recording material conveying belt and toner images of plural colors are transferred onto a recording material conveyed by a recording material conveying belt has been put into practical use. An image forming apparatus of an intermediary transfer belt type in which a plurality of color toner images primary-transferred onto an intermediary transfer belt in a superposition manner is simultaneously transferred onto a recording material at a secondary transfer portion has also been put into practical use. The photosensitive drum and a belt member such as the recording material conveying belt or the intermediary transfer belt are independently driven in some cases, but in other cases, only the belt member is provided with a driving mechanism and the photosensitive drum is rotated by contact friction with the belt member.

Japanese Laid-Open Patent Application (JP-A 2001-282015) discloses a full-color image forming apparatus in which four photosensitive drums for yellow, magenta, cyan, and black as developing colors are disposed in an upward linear section of a recording material conveying belt. In this apparatus, the four photosensitive drums are independently driven by independent driving mechanisms including independent driving motors and the recording material conveying belt is also driven by an independent driving mechanism including an independent motor. The recording material conveying belt is separated from the photosensitive drums in a process in which the apparatus is started up and reaches a predetermined process speed state and in a process in which the apparatus is stopped by reducing the process speed. By this operation, formation of rubbing damage at surfaces of the photosensitive drums and the recording material conveying belt due to an occurrence of relative friction caused by a difference in speed between the photosensitive drums and the recording material conveying belt is prevented.

JP-A 2001-282015 discloses that moment of inertia, drive load, and the like are subtly different between the photosensitive drums and the recording material conveying belt, so that the photosensitive drums and the recording material conveying belt cannot be started up with the same start-up curve. Further, JP-A 2001-282015 discloses that the photosensitive drums and the recording material conveying belt rub with each other to be damaged when the recording material conveying belt and the photosensitive drums in a contact state are started up at different speeds.

The image forming apparatus disclosed in JP-A 2001-282015 requires a large-scale mechanism for contacting and separating the recording material conveying belt and the photosensitive drums in order to prevent the mutual rubbing by separating the recording material conveying belt from the photosensitive drums during start-up. Further, in order to ensure a reproducibility of a nip state between the recording material conveying belt and the photosensitive drums brought again into contact with each other, the apparatus requires a precise positioning and pressing mechanism. For this reason, compared with the case where the contacting and separating mechanism is not provided, the resultant mechanism is increased in size, thus leading to increases in costs of parts and assembly.

Further, also in an image forming apparatus using an intermediary transfer belt, there is a possibility that photosensitive drums and the intermediary transfer belt rub with each other during start-up and rest and the like, and are damaged. In this case, not only the photosensitive drums but also the intermediary transfer belt can be damaged.

SUMMARY OF THE INVENTION

A principal object of the present invention is to provide an image forming apparatus capable of alleviating the above-described rubbing damage formed at surfaces of toner image carrying (or conveying) members by a simple method.

According to an aspect of the present invention, there is provided an image forming apparatus comprising:

an image carrying member movable while carrying a toner image, or a recording material carrying member movable while carrying a recording material onto which a toner image is to be transferred;

a contact member movable while contacting the image carrying member or the recording material carrying member; and voltage adjusting means for adjusting a voltage to be applied to the contact member so that an absolute value of the voltage when a state of the image carrying member or the recording material carrying member and the contact member is changed from a rest state in which these members are resting to a moving state in which these members are moving is larger than an absolute value of the voltage in the rest state.

According to another aspect of the present invention, there is provided an image forming apparatus comprising:

an image carrying member movable while carrying a toner image or a recording material carrying member movable while carrying a recording material onto which a toner image is to be transferred;

a contact member movable while contacting the image carrying member or the recording material carrying member; and voltage adjusting means for adjusting a voltage to be applied to the contact member so that an absolute value of the voltage when a state of the image carrying member or the recording material carrying member and the contact member is changed from a moving state in which these members are moving to a rest state in which these members are resting is larger than an absolute value of the voltage in the moving state.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, an image forming apparatus according to an embodiment of the present invention will be specifically described with reference to the drawings. The image forming apparatus according to the present invention is not limited to embodiments described below. The present invention is also applicable to other embodiments in which a part or all of constitutions in the respective embodiments are replaced with their alternative constitutions so long as increase and decrease in speed of an intermediary transfer belt and the like are controlled in a voltage application state.

For example, the present invention may be carried out by mutually replacing the intermediary transfer belt and a recording material conveying belt or mutually replacing an intermediary transfer drum and a recording material conveying drum. The present invention may also be carried out with respect to an image forming apparatus in which four or more photosensitive drums for colors including an intermediate color or an image forming apparatus using toner of a color other than yellow, magenta, cyan and black.

In this embodiment, a major portion of an image forming apparatus for forming and transferring a toner image will be described but an image forming apparatus 100 (shown in FIG. 1) can be carried out by being provided with necessary equipment and casing so as to meet various applications to a printer, various printing machines, a copying machine, a facsimile machine, a multi-purpose machine, and the like.

Incidentally, with respect to a general factors regarding constitution, various mounted power sources, detailed structure of apparatus equipment, and control of the image forming apparatus described in JP-A 2001-282015, redundant description will be omitted.

Image Forming Apparatus

First Embodiment

Figure 1:
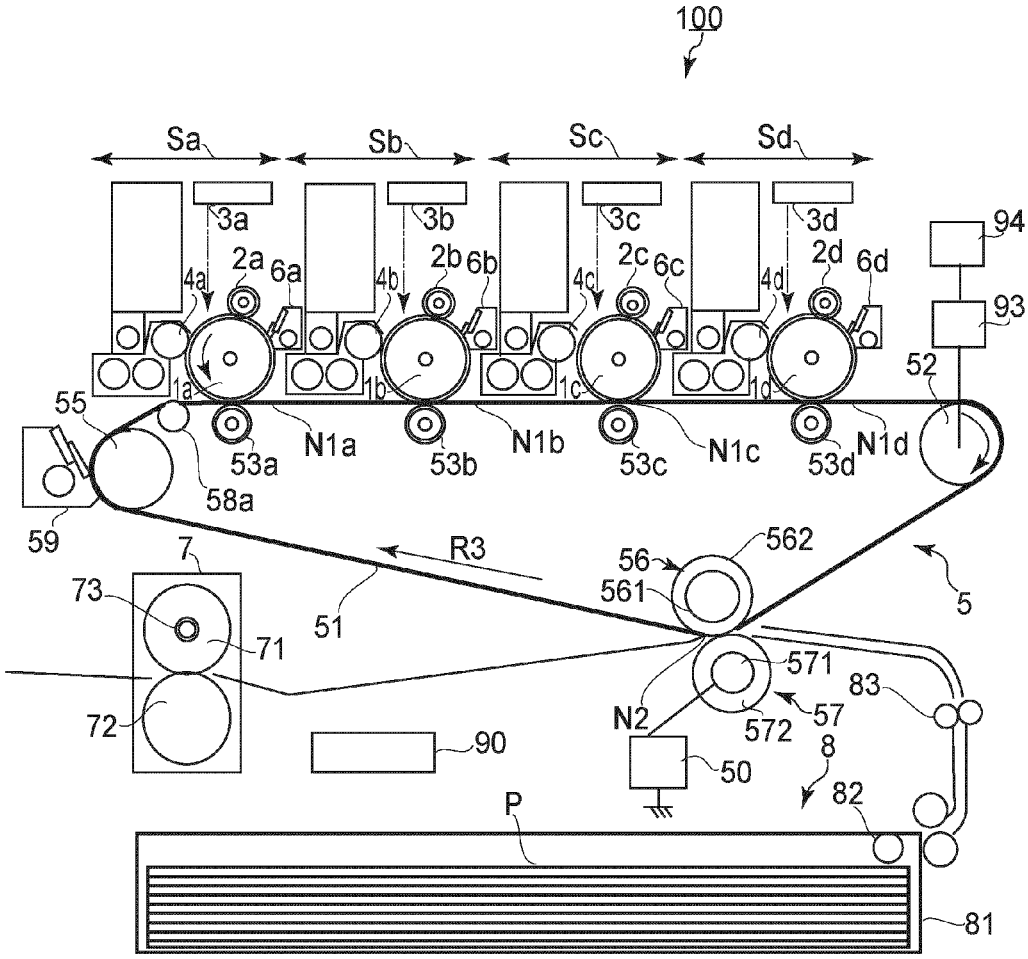
FIG. 1 is a schematic sectional view of an image forming apparatus in First Embodiment.
Figure 2:
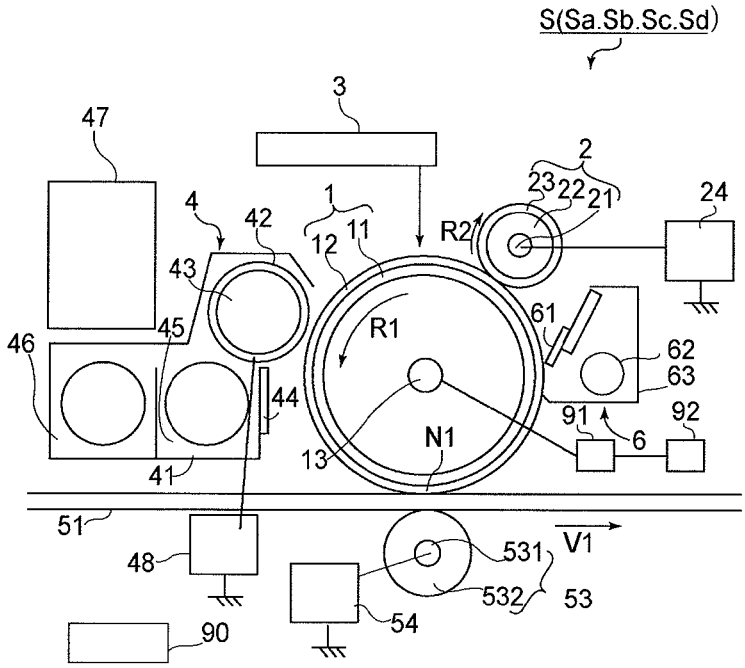
FIG. 2 is an enlarged sectional view for illustrating a constitution of an image forming apparatus.

FIG. 1 is a schematic sectional view of the image forming apparatus 100 of First Embodiment and FIG. 2 is an enlarged sectional view for illustrating an image forming station of the image forming apparatus 100. The image forming apparatus 100 of this embodiment is a tandem-type full-color electrophotographic image forming apparatus using an intermediary transfer belt.

As shown in FIG. 1, along an intermediary transfer belt (contact member or intermediary transfer member) 51, four image forming stations Sa, Sb, Sc and Sd for yellow, magenta, cyan and black, respectively, are arranged. The image forming stations Sa, Sb, Sc and Sd are independently detachably mountable and replaceable as a process unit and form a yellow toner image, a magenta toner image, a cyan toner image, and a black toner image, respectively. The image forming stations Sa, Sb, Sc and Sd have the same constitution except that the colors of the toners are different from each other. Accordingly, in FIG. 2, the image forming station is collectively represented by S (Sa, Sb, Sc, Sd) and in the following, a constitution and operation of the image forming stations Sa, Sb, Sc and Sd are also described collectively as desired.

As shown in FIG. 2, the image forming station S includes a photosensitive drum (image carrying member) 1 and its peripheral members including a charging roller 2, an exposure apparatus 3, a developing apparatus 4, a drum cleaner 6, and the like, which are successively disposed opposite to the photosensitive drum 1 with respect to a rotational direction of the photosensitive drum 1 indicated by an arrow R1. The photosensitive drum 1 is a cylindrical electrophotographic photosensitive member constituted by forming a photoconductive layer 12 on a peripheral surface of an electroconductive supporting member 11 of aluminum or the like. The photosensitive drum 1 includes a supporting shaft 13 at a center thereof and is rotationally driven in the arrow R1 direction around the supporting shaft 13 by a driving mechanism. In this embodiment, the photosensitive drum 1 is driven by the driving mechanism independent of a driving mechanism of an intermediary transfer belt 51. The driving mechanism of the photosensitive drum 1 is constituted by a photosensitive drum motor 91 and a photosensitive drum motor control portion 92. The photosensitive drum 1 is rotated by the photosensitive drum motor 91. The rotation of the photosensitive drum motor 91 is changed by the photosensitive drum motor control portion (speed changing means) 92.

The charging roller 2 is constituted in an elastic roller shape as a whole by forming a low-resistance electroconductive layer 22 and a medium-resistance electroconductive layer 23 on an outer peripheral surface of an electroconductive core metal 21 disposed at a center thereof. The charging roller 2 is rotatably supported by bearing members (not shown) at both end portions of the core metal 21 and is disposed in parallel to the photosensitive drum 1. The bearing members, at the both end portions, for supporting the charging roller 2 are urged toward the photosensitive drum 1 by an unshown pressing spring mechanism, so that the charging roller 2 is pressed against the surface of the photosensitive drum 1 with a predetermined pressing force. The charging roller 2 is rotated in a direction of an indicated arrow R2 by the rotation of the photosensitive drum in the arrow R1 direction.

The charging roller 2 electrically charges the surface of the rotating photosensitive drum 1 by applying thereto a charging bias voltage from a charging bias power source 24, thus uniformly charging the photosensitive drum 1 surface to a predetermined polarity and a predetermined potential. In this embodiment, a charge polarity of the photosensitive drum 1 is a negative polarity.

The exposure apparatus 3 (laser scanner) effects scanning exposure of the surface of the photosensitive drum 1 to laser light with a rotating mirror while effecting ON/OFF control of the laser light on the basis of image information. As a result, an electrostatic latent image depending on the image information is formed on the surface of the photosensitive drum 1.

The developing apparatus 4 includes a developing container 41 containing a two component developer comprising non-magnetic toner particles (toner) and magnetic carrier particles (carrier) in mixture. In an opening of the developing container 41 facing the photosensitive drum 1, a developing sleeve 42 rotatable while carrying thereon the developer is disposed. In the rotatable developing sleeve 42, a magnet roller 43 is non-rotationally fixed and disposed, so that the two component developer is carried on the developing sleeve 42 by a magnetic field formed by the magnet roller 43.

Below the developing sleeve 42, a regulating blade 44 for regulating the two component developer carried on the developing sleeve 42 so as to be formed in a thin layer. The developing container 41 is divided into a developing chamber 45 and a stirring chamber 46 each provided with a stirring mechanism and above the developing container 41, a developer supplying chamber 47 containing a supplying developer.

The thin layer of the two component developer carried on the developing sleeve 42 is conveyed in a developing area where the photosensitive drum 1 and the developing sleeve 42 are disposed opposite to each other with a spacing. In the developing area, the two component developer on the developing sleeve 42 form an erected chain thereof to constitute a magnetic brush.

To the developing sleeve 42, a developing bias voltage is applied by a developing bias power source 48 and in the developing area supplied with the developing bias voltage, the surface of the photosensitive drum 1 is rubbed with the magnetic brush. As a result, the toner deposited on the carrier constituting the chain of the magnetic brush is deposited at an exposed portion of the electrostatic latent image on the photosensitive drum 1 to form a toner image.

In this embodiment, the toner electrically charged to a polarity identical to the charge polarity (negative) of the photosensitive drum 1 is used and a developing bias voltage with an intermediary potential between those of an un-exposed portion and a portion at which electric charges are attenuated by the light exposure on the surface of the photosensitive drum 1 is applied. As a result, by a so-called reverse developing method, the toner is deposited selectively at the exposed portion of the electrostatic latent image, so that the toner image is formed on the surface of the photosensitive drum 1.

The primary transfer voltage 53 is constituted by disposing a cylindrical electroconductive layer 532 on an outer peripheral surface of a core metal 531 and both end portions of the core metal 531 are urged toward the photosensitive drum 1 by an unshown pressing spring mechanism. As a result, the primary transfer roller 53 is pressed against an inner peripheral surface of the intermediary transfer belt 51 by a predetermined pressing force, so that the primary transfer roller 53 is rotated by the friction with the circulating intermediary transfer belt 51. At the same time, the primary transfer roller 53 is presses the intermediary transfer belt 51 against the surface of the photosensitive drum 1 to form a primary transfer portion (nip) N1, for primary-transferring the toner image, between the photosensitive drum 1 and the intermediary transfer belt 51.

During image formation, to the core metal 531 of the primary transfer roller 53, a primary transfer voltage of a positive polarity opposite to the normal charge polarity (negative) of the toner is applied by a primary transfer bias power source (voltage adjusting means) 54. As a result, between the primary transfer roller 53 and the photosensitive drum 1, an electric field for urging the negative-polarity toner from the photosensitive drum 1 toward the intermediary transfer belt 51 is formed, so that the toner image on the photosensitive drum 1 is primary-transferred onto the surface of the intermediary transfer belt 51.

The drum cleaner 6 scrapes a deposited matter (transfer residual toner or the like) remaining on the surface of the photosensitive drum 1 after passed through the primary transfer portion N1 from the surface of the photosensitive drum 1 into a cleaner housing 63. The scraped deposited matter is conveyed by a conveying screw 62 and collected in an unshown waste toner containing portion provided at one end portion of the cleaner housing 63. The cleaning blade 61 is brought into contact with the surface of the photosensitive drum 1 at a predetermined angle and a predetermined pressure by an unshown pressing mechanism.

As shown in FIG. 1, the intermediary transfer unit 5 for primary-transferring toner images successively onto the surface of the circulating intermediary transfer belt 51 in a superposition manner is disposed below the photosensitive drums 1*a* to 1*d*. The intermediary transfer unit 5 includes the primary transfer rollers 53*a* to 53*d*, a driving roller 52, a follower roller 55, an inner secondary transfer roller 56, an outer secondary transfer roller 57, and a belt cleaner 59. The primary transfer rollers 53*a* to 53*d* disposed at the inner peripheral surface side of the intermediary transfer belt 51 are constituted as described above.

The intermediary transfer belt 51 are extended and supported by the driving roller 52, the follower roller 55, and the inner secondary transfer roller 56 and is circulated in a direction of an indicated arrow R3 by being driven by the driving roller 52. The driving roller 52 is rotated by a driving roller motor 93. The rotation of the driving voltage motor 93 is changed by a driving roller motor control portion (speed changing means) 94.

At an opposing position to the inner secondary transfer roller 56 at the outer peripheral surface side of the intermediary transfer belt 51, the outer secondary transfer roller 57 is disposed. The outer secondary transfer roller 57 is pressed against the inner secondary transfer roller 56 through the intermediary transfer belt 51 by an unshown pressing spring mechanism. As a result, the outer secondary transfer roller 57 is rotated by the friction with the intermediary transfer belt 51 and forms a secondary transfer portion (nip) N2 between the outer secondary transfer roller 57 and the intermediary transfer belt 51.

During full-color image formation, toner images of yellow, magenta, cyan and black are formed on the photosensitive drums 1*a*, 1*b*, 1*c* and 1*d* of the image forming stations Sa, Sb, Sc and Sd, respectively. The respective color toner images are formed at different times so that their leading ends can coincide with each other on the surface of the intermediary transfer belt 51 and are primary-transferred successively onto the intermediary transfer belt 51 in the superposition manner by using the primary transfer rollers 53*a* to 53*d*.

The four color toner images superposed and primary-transferred onto the intermediary transfer belt 51 are conveyed to the secondary transfer portion N2 by the circulation of the intermediary transfer belt 51 and are simultaneously secondary-transferred onto the recording material P supplied by a recording material supplying mechanism 8. The recording material supplying mechanism 8 picks up the recording material P one by one from a cassette 81 in which sheets of the recording material P are stacked, by a pick-up roller 82. Then, the recording material supplying mechanism 8 sends the recording material P to the secondary transfer portion N2 with timing synchronized with the leading ends of the four color toner images on the intermediary transfer belt 51.

The driving roller 52, the follower roller 55 and the inner secondary transfer roller 56 are grounded to have a ground potential. During the secondary transfer, to the outer secondary transfer roller 57, a secondary transfer voltage of a positive polarity opposite to the normal charge polarity (negative) of the toner is applied from a secondary transfer bias power source 50. As a result, between the inner secondary transfer roller 56 and the outer secondary transfer roller 57, an electric field for urging the negative-polarity toner image on the intermediary transfer belt 51 toward the recording material P is formed. In response to this electric field, the four color toner images are secondary-transferred simultaneously from the intermediary transfer belt 51 onto the recording material P. The recording material P onto which the toner images are secondary-transferred is conveyed to a fixing apparatus 7.

The fixing apparatus is constituted by bringing a rotatably disposed fixing roller 71 into contact with a pressing roller which is rotatably driven. The fixing roller 71 includes a halogen lamp heater 73 therein and a surface temperature thereof is adjusted at a constant level by controlling a voltage supplied to the halogen lamp heater 73. During a process in which the recording material P passes through a pressing nip between the fixing roller 71 and the pressing roller 72 which are rotated at a constant speed, the recording material P is pressed and heated at substantially same pressure and temperature at both surfaces thereof. As a result, an unfixed toner image on the surface of the recording material P is melted and fixed on the surface of the recording material P, so that a full-color image is formed on the recording material P.

A deposited matter (secondary transfer residual toner or the like) having passed through the secondary transfer nip and remaining on the outer peripheral surface of the intermediary transfer belt 51 is removed and collected by a belt cleaner 59. The belt cleaner 59 has the same constitution as that of the drum cleaner 6*a*.

A process speed of the image forming apparatus 100 corresponds to a peripheral speed of the photosensitive drum 1 and a circulating speed of the intermediary transfer belt 51 and is 100 mm/sec. That is, during the image formation, the peripheral speed of the photosensitive drum 1 and the circulating speed of the intermediary transfer belt 51 are substantially equal to each other. The term "substantially equal" means that these speeds are within ±1% relative to each other. The intermediary transfer belt 51 is formed of a polyimide (PI) resin material having a surface resistivity of $10^{12}\Omega/\partial$ and a thickness of 100 μm. The surface resistivity is measured by using a probe in accordance with JIS-K6911 method under a condition including an applied voltage of 100 V, an application time of 60 sec, and an environment of 23° C./50% RH.

The material for the intermediary transfer belt 51 is not limited to the PI resin material but may also be dielectric resin materials such as polycarbonate (PC), polyethylene terephthalate (PET) and polyvinylidene fluoride (PVDF) and other materials which have different volume resistivities and thicknesses. The primary transfer roller 53 is constituted by coating a 4 mm-thick electroconductive urethane sponge layer 532 on a core metal 531 having an outer diameter of 8 mm and has an electric resistance of about $10^6\Omega$. The electric resistance of the primary transfer roller 53 is measured in such a manner that the roller 53 is rotated at a peripheral speed of 50 mm/sec in contact with a metal roller with a load of 5N (500 gW) in an environment of 23° C./50% RH and a voltage of 500 V is applied to the core metal 531. The inner secondary transfer roller 56 is constituted by coating a 2 mm-thick electroconductive solid silicone rubber layer 562 on a core metal 561 having an outer diameter of 18 mm and has an electric resistance of about $10^4\Omega$ measured by the above manner. The outer secondary transfer roller 57 is constituted by coating a 4 mm-thick electroconductive EPDM rubber sponge layer 572 on a core metal 571 having an outer diameter of 20 mm and has an electric resistance of about $10^8\Omega$ measured by the above manner except for an applied voltage of 2000 V.

In the image forming apparatus 100, a driving motor for the photosensitive drum 1 and a driving motor for the intermediary transfer belt 51 are independent of each other. Accordingly, when a difference in peripheral speed is generated between the photosensitive drum 1 and the intermediary transfer belt 51, the intermediary transfer belt 51 and the photosensitive drum 1 which are pressed by the primary transfer roller 53 rub against each other, thus being damaged. The peripheral speed difference is liable to occur particularly during a rotation start-up period in which the photosensitive drum 1 and the intermediary transfer belt 51 each rotate at predetermined peripheral speeds immediately after actuation. Even when the respective driving motors are controlled so that the speeds of photosensitive drum 1 and the intermediary transfer belt 51 reach steady-state speeds with the same peripheral speed rise curve, moment of inertia and loaded states of the photosensitive drum 1 and the intermediary transfer belt 51 are subtly different from each other. As a result, the peripheral speed difference is caused to occur, so that the surfaces of the photosensitive drum 1 and the intermediary transfer belt 51 rub against each other.

When the surface of the photosensitive drum 1 is damaged by the rubbing against the intermediary transfer belt 51, the damage appears in an output image as an image defect. A similar image defect occurs also in the case where the surface of the intermediary transfer belt 51 is damaged.

Incidentally, even in the case where the photosensitive drum 1 and the intermediary transfer belt 51 are driven by distributing a driving force from the same (common) driving motor by means of a toothed belt mechanism or the like, moment of inertia and loaded states of the photosensitive drum 1 and the intermediary transfer belt 51 are subtly different from each other, so that the peripheral speed difference is caused to occur at their contact surface due to play or the like at a drive transmitting portion. Further, even in an image forming apparatus for directly transferring a toner image from the photosensitive drum onto the recording material by using a recording material conveying belt, the peripheral speed difference occurs when the rotation start-up of the recording material conveying belt and the photosensitive drum in a contact state.

In the image forming apparatus 100, by using the primary transfer bias power source 54, the surface of the intermediary transfer belt 51 and the surface of the photosensitive drum 1 are electrically engaged. As a result, in addition to the frictional force by the press-contact, an electrostatic attraction force is also exerted so as to ensure such a surface friction-based driving force as to absorb a difference in moment of inertia or loaded state to some extent. As a result, compared with the case of relying on only the press-contact, a frictional force between the surfaces is enhanced, so that the peripheral surface difference less occurs to reduce a time in which the surface rub against each other.

Figure 3:
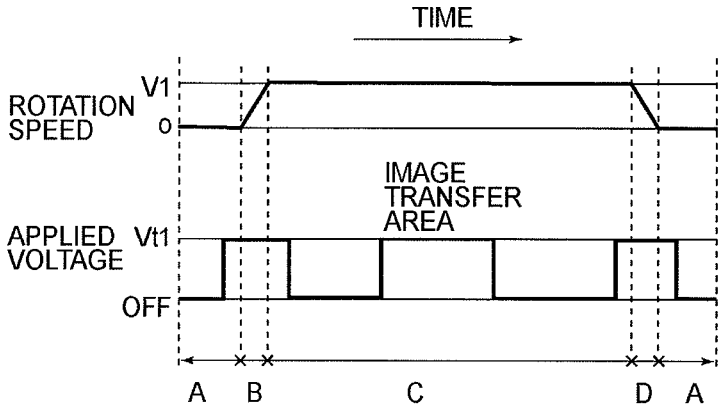
FIG. 3 is a time chart of voltage application in First Embodiment.
Figure 4:
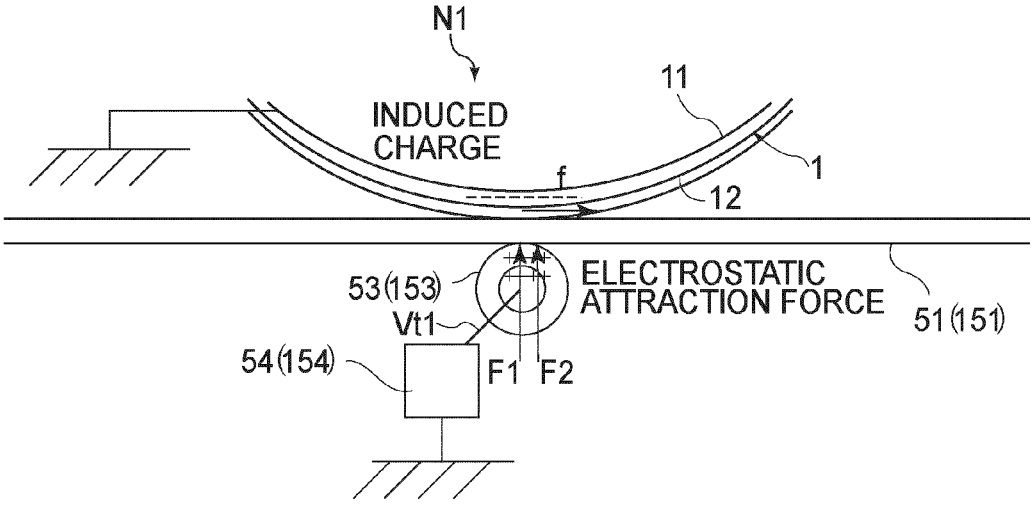
FIG. 4 is a partially enlarged sectional view of a portion including a primary transfer portion.

FIG. 3 is a time chart of voltage application in this embodiment (First Embodiment) and FIG. 4 is partially enlarged sectional view showing the primary transfer portion and the neighborhood thereof.

In the image forming apparatus 100, a primary transfer voltage Vt1 is applied to the primary transfer roller 53 during start-up of rotation and during rest of rotation, so that the above-described mutual rubbing is obviated. A control portion 90 causes the primary transfer bias power source 54 to output (apply) the primary transfer voltage Vt1 to the primary transfer roller 53 during a rotation start-up period B for actuating the photosensitive drum 1 and the intermediary transfer belt 51 and during a rest period D for reducing peripheral speeds of rotation of the photosensitive drum 1 and the intermediary transfer belt 51 to stop these members, as shown in FIG. 3. As a result, a friction-engaging force between the photosensitive drum 1 and the intermediary transfer belt 51 is enhanced.

After the peripheral speeds of the photosensitive drum 1 and the intermediary transfer belt 51 reach a predetermined peripheral speed V1, the primary transfer voltage Vt1 is released and is applied again in an image transfer area (period) for primary-transferring the toner image onto the intermediary transfer belt 51. When the image transfer period is completed, the primary transfer voltage Vt1 is released and is applied again slightly before a reduce reduction in speed of the photosensitive drum 1 and the intermediary transfer belt 51.

In a primary transfer voltage application sequence in this embodiment, the primary transfer voltage (Vt1) is rendered off in periods other than a period including the start-up period B (from a rest (stop) state A to a moving (rotating) state C), a period including the rest period D (from the moving state C to the rest state A), and the image transfer period. As a result, an unnecessary voltage is not applied to the primary transfer roller 53, so that it is possible to obviate a problem such as energization deterioration of the primary transfer roller 53.

As shown in FIG. 4, when the primary transfer voltage Vt1 is applied from the primary transfer bias power source 54 to the primary transfer roller 53, electric charges are induced in the electroconductive supporting member 11 of the photosensitive drum 1. In this embodiment, by applying a positive-polarity primary transfer voltage Vt1 from the primary transfer bias power source 54 to the primary transfer roller 53, negative polarity electric charges are induced in the electroconductive supporting member 11 of the photosensitive drum 1. By a resultant electrostatic force generated by these positive and negative electric charges, an electrostatic attraction force F1 is exerted on the photosensitive drum 1 and the intermediary transfer belt 51.

Here, an amount of electric charge supplied from the primary transfer roller 53 side to the back (rear) surface of the intermediary transfer belt 51 is taken as Q (C) and an amount of electric charge supplied to the electroconductive supporting member 11 of the photosensitive drum 1 is taken as q (C). Further, a thickness of the photoconductive layer 12 is taken as Ti (m) and a thickness of the intermediary transfer belt 51 is taken as t2 (m). In this case, the attraction force F1 is represented by the following equation:

$$F1=kQq/r^2,$$

wherein k represents a constant of proportionality and r represents the sum of t1 and t2($r$=t1+t2).

Further, when an electrostatic capacity in the primary transfer portion N1 is C, the electric charge amount Q supplied to the primary transfer portion N1 is represented by:

$$Q=CV.$$

Accordingly, the attraction force F1 is proportional to the square of a primary transfer voltage V. Therefore, the attraction force F1 is represented by:

$$F1=k(CV/R)^2.$$

A frictional force f between the photosensitive drum 1 and the intermediary transfer belt 51 is represented by:

$$f=\mu\times N,$$

wherein μ represents a friction coefficient and N represents a normal reaction. The normal reaction N is represented by:

$$N=F1+F2,$$

wherein F1 represents the above-described attraction force and F2 represents a pressure (pressing force) from the primary transfer roller 53 toward the photosensitive drum 1.

Accordingly, the above-described frictional force f is represented by:

$$f=\mu(k(CV/r)^2+F2).$$

Thus, by increasing the primary transfer voltage V, it is possible to increase the frictional force f between the photosensitive drum 1 and the intermediary transfer belt 51.

In this embodiment, by utilizing the above-described phenomenon, the primary transfer voltage is applied to the primary transfer roller during the start-up and rest of the photosensitive drum 1 and intermediary transfer belt 51. As a result, the frictional force between the photosensitive drum 1 and the intermediary transfer belt 51 is increased, so that an occurrence of a difference in speed (slip) between the photosensitive drum 1 and the intermediary transfer belt 51 is suppressed.

Incidentally, it is also possible to drive the photosensitive drum 1 and the driving roller 52 by distribution of a driving force of the driving roller motor 92 with a toothed belt or the like without providing the photosensitive drum motor 91. That is, by distributing a driving force of a common driving source, it is possible to drive the photosensitive drum 1 and the driving roller 52. Further, it is also possible to rotate the photosensitive drum 1 by the frictional force thereof with the intermediary transfer belt 51 without providing a mechanism for distributing driving forces of the photosensitive drum motor 91 and the driving roller motor 93 to the photosensitive drum 1.

Second Embodiment

Figure 5:
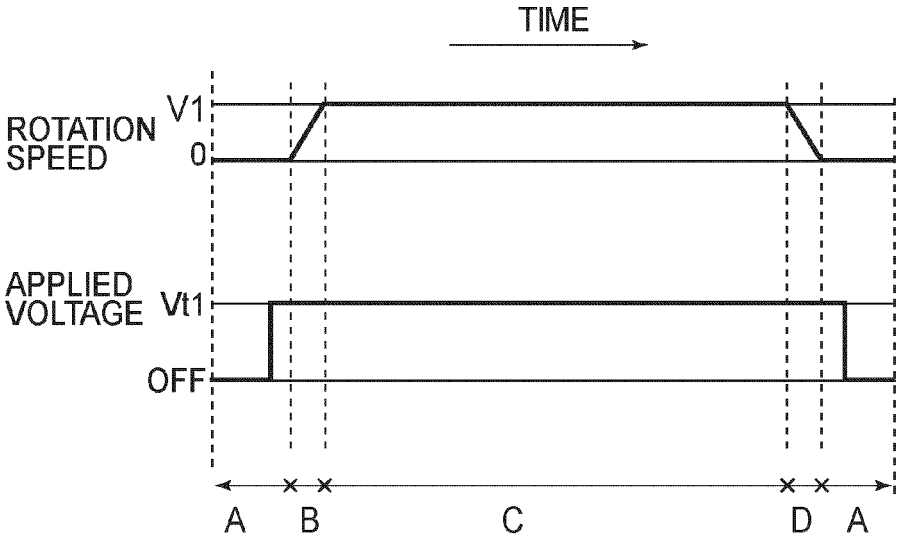
FIGS. 5, 6 and 7 are time charts of voltage application in Second Embodiment, Third Embodiment and Fourth Embodiment, respectively.

FIG. 5 is a time chart of voltage application in this embodiment. In this embodiment, description is made by replacing the time chart of FIG. 3 with that of FIG. 5.

FIG. 5 shows rotational speeds of the photosensitive drum 1 and the intermediary transfer belt 51 during image formation by control in this embodiment and corresponding voltages applied to the primary transfer roller 53 during the image formation.

As shown in FIG. 5, in this embodiment, before the photosensitive drum 1 and the intermediary transfer belt 51 are rotationally actuated, the primary transfer voltage Vt1 is applied to the primary transfer roller 53. Further, after the rotations of the photosensitive drum 1 and the intermediary transfer belt 51 are stopped, the application of the primary transfer voltage Vt1 to the primary transfer roller 53 is rendered off. In this case, the primary transfer voltage Vt1 of +500 V, which is a voltage during the primary transfer of the toner image, is continuously applied.

In both of a start-up period in which the peripheral speed is changed from 0 to a process speed V1 and a rest period in which the peripheral speed is changed from the process speed V1 to 0, a difference in surface speed between the photosensitive drum 1 and the photosensitive drum 1 and the intermediary transfer belt 51 is liable to occur. When such a phenomenon occurs, the photosensitive drum 1 and the intermediary transfer belt 51 rub against each other in the primary transfer portion N1 in which they are pressed by the primary transfer roller 53, so that both of the photosensitive drum 1 and the intermediary transfer belt 51 are damaged. The resultant damages appear in an output image.

However, in this embodiment, the present invention 1 and the intermediary transfer belt 51 are actuated in a state in which a maximum frictional force is enhanced by applying an electrical attraction force in the rest (stop) state, so that speed rise can be executed in a state in which a large slip resistance is kept. Further, after the rest, the application of primary transfer voltage Vt1 is continued for a while, so that a press-contact state between the photosensitive drum 1 and the intermediary transfer belt 51 is stabilized and enhanced. Thus, it is possible to achieve the enhanced maximum frictional force during next start-up.

Third Embodiment

Figure 6:
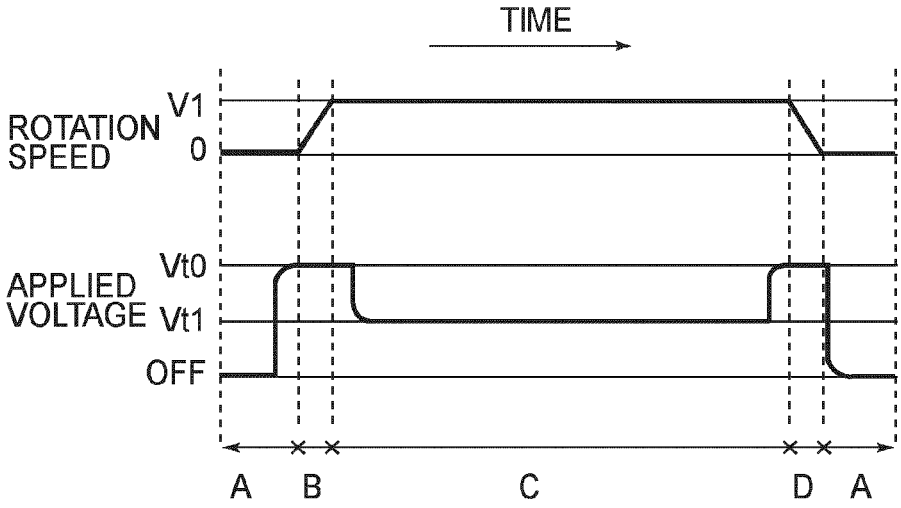

FIG. 6 is a time chart of voltage application in this embodiment. In this embodiment, description is made by replacing the time chart of FIG. 3 to that of FIG. 6.

A voltage applied to the primary transfer roller 53 during the start-up and the rest is not necessarily identical to the primary transfer voltage Vt1 applied during the primary transfer of the toner image. As shown in FIG. 6, in this embodiment, before the start-up of the rotations of the photosensitive drum 1 and the intermediary transfer belt 51, an adsorption (attraction) voltage Vt0 higher (in terms of an absolute value) than the primary transfer voltage Vt1 is applied to the primary transfer roller 53. Then, after the rotation speed is stabilized, the applied voltage is changed to the primary transfer voltage Vt1 during the image transfer. Further, before the rotations of the photosensitive drum 1 and the intermediary transfer belt 51 are stopped, the primary transfer voltage Vt1 is switched to the adsorption voltage Vt0 and after the rotations are stopped, the application of the adsorption voltage Vt0 is rendered off. In this embodiment, the adsorption voltage Vt0 during the start-up and rest of the rotations is +800 V and the primary transfer voltage Vt1 during the transfer of the toner image is +500 V.

In this embodiment, the adsorption voltage Vt0 providing a strong attraction force during the start-up and the rest of the rotations required for enhancing the electrostatic attraction force between the photosensitive drum 1 and the intermediary transfer belt 51 is applied. Further, during the primary transfer of the toner image, the primary transfer voltage Vt1 suitable for the primary transfer is applied. Accordingly, compared with Second Embodiment, the difference in surface speed is less liable to occur during the start-up and rest of rotations.

When an extremely high adsorption voltage Vt0 is applied in a rest state of the photosensitive drum 1, an electrical history remains on the photosensitive drum 1, thus adversely affecting an image during image formation in some cases. This electrical history is hereinafter referred to as an "electrostatic memory". The electrostatic memory is liable to occur particularly by overshooting of a current during the voltage application. Therefore, in this embodiment, as shown in FIG. 6, the rising of the adsorption voltage Vt0 is blunted, so that an occurrence of the electrostatic memory due to instantaneous current flow in a large amount in the rising of the voltage application is obviated.

Fourth Embodiment

Figure 7:
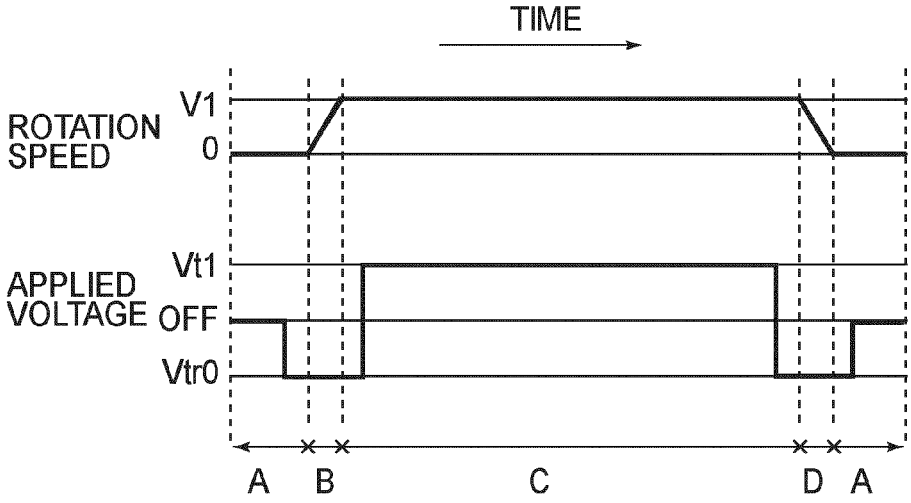

FIG. 7 is a time chart of voltage application in this embodiment. In this embodiment, description is made by replacing the time chart of FIG. 3 with that of FIG. 7.

In Third Embodiment, as shown in FIG. 6, the adsorption voltage Vt0 higher than the ordinary primary transfer voltage Vt1 is applied, so that there is a possibility of the occurrence of the electrostatic memory with respect to the photosensitive drum 1. In the case of Third Embodiment, the photosensitive drum 1 is negatively charged by the charging roller 2, so that the adsorption voltage Vt0 of a positive polarity opposite to the charge polarity of the photosensitive drum 1 can be particularly liable to occur.

In this embodiment (Fourth Embodiment), as shown in FIG. 7, as a voltage Vtr0 applied to the start-up and rest of the rotations of the photosensitive drum 1 and the intermediary transfer belt 51, a voltage of −800 opposite in polarity to that during the primary transfer of the toner image. In this way, during the rotation start-up and rest, the voltage Vtr0 of the polarity opposite to that during the primary transfer is outputted from the primary transfer bias power source 54 and the voltage Vtr0 of the polarity identical to the charge polarity of the photosensitive drum 1 is applied to the primary transfer roller 53. As a result, it is possible to obtain a sufficient electrostatic attraction force without causing the occurrence of the electrostatic memory.

The sequences of the transfer voltage application during the starting and rest of the rotations of the photosensitive drum 1 and the intermediary transfer belt 51 are described in First to Fourth Embodiments but the present invention is not limited thereto. For example, it is also possible to employ a constitution in which different adsorption (attraction) voltages Vt0 are set between the periods of the rotation start-up and rest and a constitution in which the adsorption voltage Vt0 applied during the rotation start-up is gradually decreased.

In the image forming apparatus 100 shown in FIG. 1, the driving mechanisms for the photosensitive drum 1 and the intermediary transfer belt 51 are independently provided. Accordingly, by attracting the photosensitive drum 1 and the intermediary transfer belt 51 to each other during the rotation start-up and rest, in the case of rotating these members at the completely identical speed, a speed difference between the respective driving means is absorbed by the driving transmitting means such as gears, belts, and the like.

For example, during the start-up of the rotations of the photosensitive drum 1 and the intermediary transfer belt 51, a rising curve of the rotation speed of the photosensitive drum 1 is steeper than that of the intermediary transfer belt 51 in some cases. In such cases, in this embodiment in which the speed difference between the photosensitive drum 1 and the intermediary transfer belt 51 is not caused by the presence of the electrostatic attraction force, the driving force of the photosensitive drum 1 is transmitted toward the driving means for the intermediary transfer belt 51 through the photosensitive drum 1 and the intermediary transfer belt 51. When the difference in rising curve between the photosensitive drum 1 and the intermediary transfer belt 51 is small, i.e., when the speed difference and a corresponding time difference are small, these differences are absorbed by plays of the gears and the belts as the driving transmitting means.

However, in the case where the difference in rising curve is relatively large and driving forces of the respective driving means affect each other, it is preferable that a torque limiter is provided to either one of driving force transmission paths of the driving mechanisms for the photosensitive drum 1 and the intermediary transfer belt 51.

For example, in the case of providing the torque limiter in the driving force transmission path of the photosensitive drum 1, when the rising curves of the rotation speeds of the photosensitive drum 1 and the intermediary transfer belt 51 are different from each other, a driving force exceeding a predetermined torque cannot be transmitted from the driving mechanism of the photosensitive drum 1. For this reason, the photosensitive drum 1 is driven by the frictional force with the intermediary transfer belt 51.

The torque limiter is known, so that detailed description thereof is omitted. In the present invention, it is possible to employ a torque limiter for transmitting a torque by a frictional force generated in a friction material by a compressive force of a coil spring or a torque limiter using a viscous fluid. Further, it is also possible to use an electromagnetic joint, capable of controlling a transmitting torque, such as an electromagnetic powder clutch or the like.

As described above, in First to Fourth Embodiments, by utilizing the primary transfer roller 53 and the primary transfer bias power source 54, slip is suppressed by enhancing the electrostatic attraction force between the photosensitive drum 1 and the intermediary transfer belt 51. Accordingly, it is possible to suppress the occurrence of damages on the photosensitive drum 1 and the intermediary transfer belt 51.

Fifth Embodiment

Figure 8:
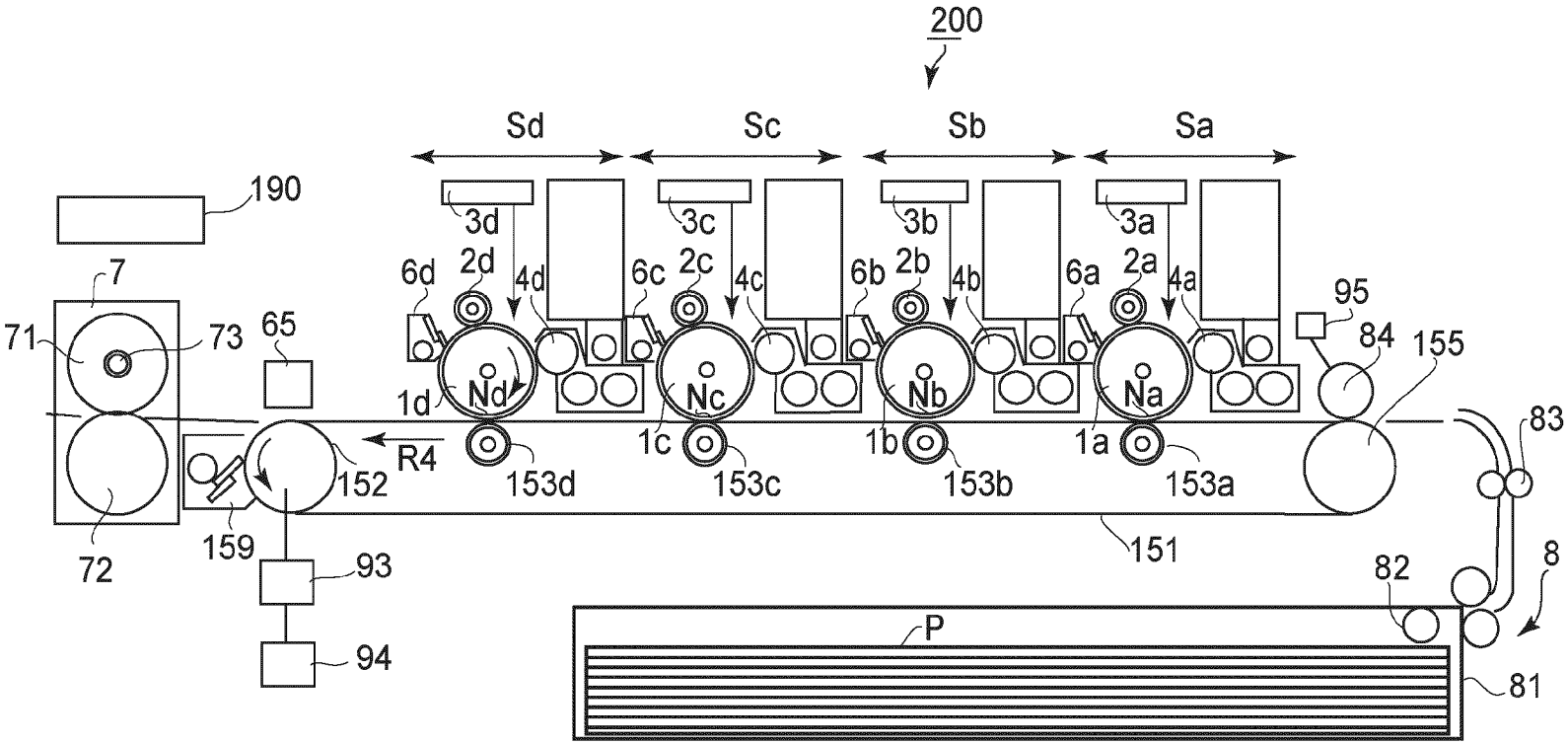
FIG. 8 is a schematic sectional view of an image forming apparatus in Fifth Embodiment.
Figure 9:
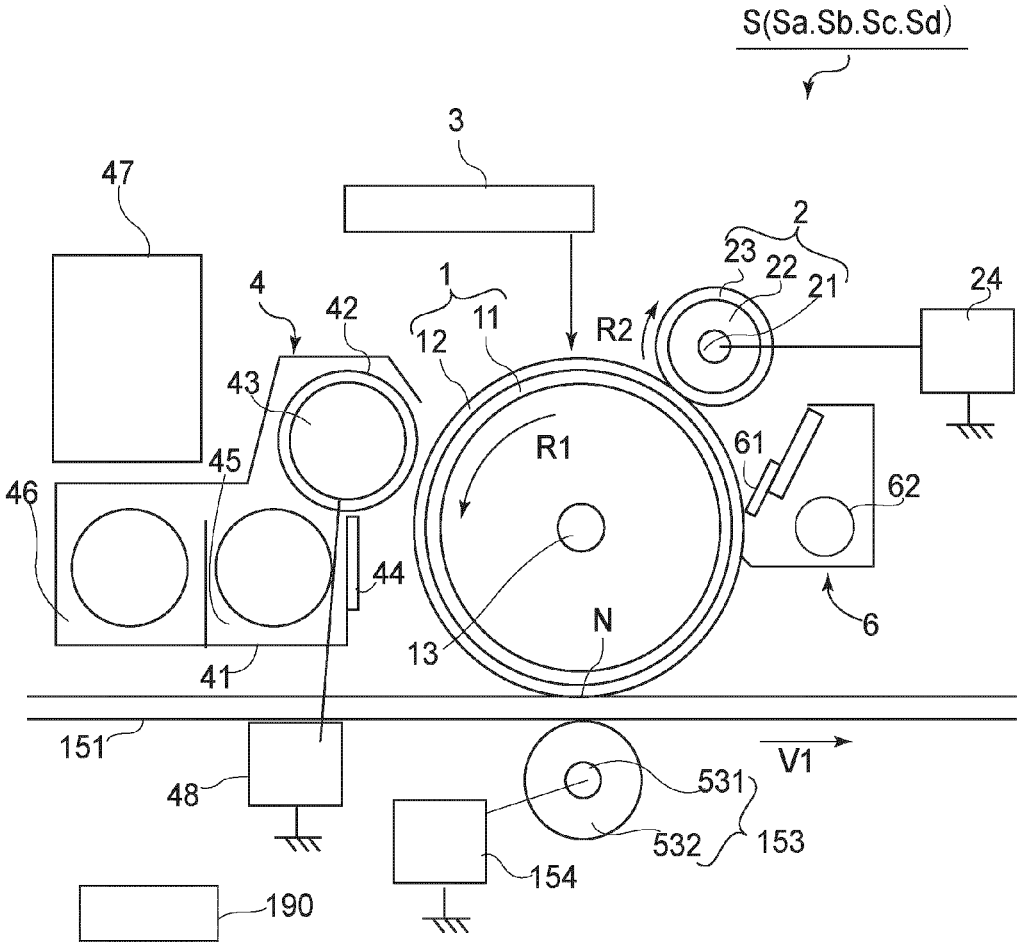
FIG. 9 is an enlarged sectional view for illustrating a constitution of an image forming station.

FIG. 8 is a schematic sectional view of the image forming apparatus 200 of Fifth Embodiment and FIG. 9 is an enlarged sectional view for illustrating an image forming station of the image forming apparatus 200. The image forming apparatus 200 of this embodiment is a direct transfer-type full-color electrophotographic image forming apparatus using a recording material conveying belt (recording material carrying member) 151. The image forming apparatus 200 is assembled by constituent members common to those used in the image forming apparatus 100 of First Embodiment except that the recording material conveying belt 151 is used in place of the intermediary transfer belt 51. Accordingly, the constituent members, shown in FIGS. 8 and 9, having the substantially same function and constitution as those of the constituent members shown in FIGS. 1 and 2 are represented by identical reference numerals or symbols and detailed description thereof is omitted.

As shown in FIG. 8, toner images formed in the same order as that in the image forming apparatus 100 are formed on the recording material P in the image forming apparatus 200, so that the order of the image forming stations Sa, Sb, Sc and Sd is in reverse with respect to those in the image forming apparatus 100. The image forming stations Sa, Sb, Sc and Sd have the substantially same constitution except that the colors of the toners are different from each other. Accordingly, in FIG. 9, the image forming station is collectively represented by S (Sa, Sb, Sc, Sd) and in the following, a constitution and operation of the image forming stations Sa, Sb, Sc and Sd are also described collectively as desired.

The image forming apparatus 200 includes a belt member, capable of being circulated and moved while carrying the recording material, i.e., the recording material conveying belt 151, disposed adjacent to the photosensitive drums (image carrying members or image conveying members) 1*a*, 1*b*, 1*c* and 1*d* at the image forming stations Sa, Sb, Sc and Sd. The recording material conveying belt (recording material carrying member or image conveying member) 151 is extended between a driving roller 151 and a follower roller 155. The recording material conveying belt 151 is supplied with a driving force by the driving roller 152 to be circulated and moved in a direction of an indicated arrow R4.

As shown in FIG. 9, at a position opposite to the photosensitive drum 1 at an inner surface side of the recording material conveying belt 151, a transfer roller 153 is disposed. The recording material conveying belt 151 is urged toward the photosensitive drum 1 by the transfer roller 153 to form a transfer portion (nip) N in which the photosensitive drum 1 and the recording material conveying belt 151 contact each other.

As shown in FIG. 8, the toner images formed on the photosensitive drums 1*d* to 1*d* at the image forming stations Sa to Sd are successively multi-transferred onto the recording material P such as paper or the like.

During image formation, the recording material P is conveyed onto the recording material conveying belt 151 by a recording material supplying mechanism 8. The recording material supplying mechanism 8 picks up the recording material P one by one from a cassette 81 as a recording material accommodating portion by a pick-up roller 82 and conveys the recording material P toward the recording material conveying belt 151 through conveying rollers 82 and the like. The recording material P is electrically charged by an adsorption (attraction) roller 84 supplied with an adsorption (attraction) voltage from an adsorption (attraction) bias power source 95 and is conveyed through transfer portions Na to Nd in an electrically attracted state on the recording material conveying belt 151.

For example, during full-color image formation, toner images of respective colors are formed in the photosensitive drums 1*a* to 1*d* at the image forming stations Sa to Sd. The color toner images are supplied with transfer biases from the transfers 53*a* to 53*d* disposed opposite to the photosensitive drums 1*a* to 1*d*, respectively, through the recording material P and the recording material conveying belt 151, thus being successively transferred onto the recording material P. These transfer biases have a polarity opposite to the charge polarity of the toner images.

After the transfer process at the transfer portions Na to Nd is completed, the recording material P is separated from the recording material conveying belt 151 by receiving a separating bias from a separating and discharging member 65 to be conveyed into the fixing apparatus 7. The fixing apparatus 7 heats and presses the recording material P to fix thereon a full-color toner image. On the other hand, toner or the like deposited on the recording material conveying belt 151 after the transfer process is removed and collected by a transfer belt cleaner 159.

As a material for the recording material conveying belt 151, similarly as in the case of the intermediary transfer belt 51 shown in FIG. 1, it is possible to employ dielectric resin materials such as PC, PET, and PVDF.

In this embodiment, the recording material conveying belt 151 is formed of a carbon black-dispersed polyimide (PI) resin material having a surface resistivity of $10^{14}\Omega/\partial$ and a thickness of 80 μm. The surface resistivity is measured by using a probe in accordance with JIS-K6911 method under a condition including an applied voltage of 100 V, an application time of 60 sec, and an environment of 23° C./50% RH.

The material for the recording material conveying belt 151 is not limited to the PI resin material but may also be other materials which have different volume resistivities and thicknesses. The transfer roller 153 has the same constitution as that of the above-described primary transfer roller 53, i.e., is constituted by coating a 4 mm-thick electroconductive urethane sponge layer 532 on a core metal 531 having an outer diameter of 8 mm and has an electric resistance of about $10^{6.5}\Omega$. The electric resistance of the transfer roller 153 is measured in such a manner that the roller 153 is rotated at a peripheral speed of 50 mm/sec in contact with an electrically grounded metal roller with a load of 5N (500 gW) and a voltage of 100 V is applied to the core metal 531 to obtain a current from which the electric resistance is calculated. In this embodiment, the surface speeds of the photosensitive drum 1 and the recording material conveying belt 151 are 100 mm/sec, so that these members are moved at the substantially equal speed, i.e., speeds with a difference therebetween within ±1%.

In the image forming apparatus 200, the photosensitive drum 1 does not have the independent driving mechanism as in the case of the image forming apparatus 100 shown in FIG. 1, so that the photosensitive drum 1 is rotated by the frictional driving force with respect to the circulating recording material conveying belt 151 after being actuated. Accordingly, different from First Embodiment, relative friction between the photosensitive drum 1 and the recording material conveying belt 151 due to a difference in rising curve of the rotation speeds is less liable to occur but there is a possibility that relative friction due to a difference in moment of inertia or a change in load is caused to occur. For this reason, similarly as in First Embodiment and the like, this embodiment is also directed to solve the problem of the peripheral speed difference caused during the rotation start-up of the photosensitive drum 1 and the recording material conveying belt 151.

The image forming apparatus 200 includes the driving roller 152 as the driving mechanism for the recording material conveying belt 151, and the driving roller 152 is rotated by the driving roller motor 93. Further, the rotation speed of the driving roller motor 93 is changed by a driving roller motor control portion (speed changing means) 94. When the slip between the photosensitive drum 1 and the recording material conveying belt 151 can be eliminated, a more stable image free from color deviation can be obtained when compared with the case of providing the driving mechanism to both of the photosensitive drum 1 and the recording material conveying belt 151.

The image forming apparatus 200 includes the driving roller 152 as the driving mechanism for the recording material conveying belt 151 and the driving roller 152 is rotated by the driving roller motor 93. Further, the rotation speed of the driving roller motor 93 is changed by a driving roller motor control portion (speed changing means) 94. When the slip between the photosensitive drum 1 and the recording material conveying belt 151 can be eliminated, a more stable image free from color deviation can be obtained when compared with the case of providing the driving mechanism to both of the photosensitive drum 1 and the recording material conveying belt 151.

In order to alleviate the slip between the photosensitive drum 1 and the recording material conveying belt 151, the image forming apparatus 200 effects the same control as in that in First Embodiment. A control portion 190, as shown in FIG. 3, causes a transfer bias power source 154 to output the transfer voltage Vt1 of a polarity opposite to the charge polarity of the toner image to the transfer roller 153 during both of the start-up period for actuation and the speed-reducing rest period. As a result, an electrical attractive force is generated between the photosensitive drum 1 and the recording material conveying belt 151 to increase the press-contact force therebetween, thus enhancing the friction driving force to reduce the frequency of occurrences of relative friction, with the result that rubbing damage is less liable to occur.

Incidentally, during both of the start-up period and the rest period, by causing the transfer bias power source 154 to output a voltage V of a polarity identical to the charge polarity of the toner image to the transfer roller 153, it is also possible to alleviate the slip.

Further, a similar effect is also achieved by replacing the transfer voltage application sequence shown in FIG. 3 with those shown in FIGS. 5, 6 and 7. Particularly, in this embodiment (Fifth Embodiment), the photosensitive drum 1 is not provided with the driving mechanism, so that it is preferable that the transfer voltage application sequences shown in FIGS. 5, 6 and 7 in which the transfer voltage is steadily applied during the rotation are employed.

In the image forming apparatus 200 of this embodiment, the photosensitive drum 1 is not provided with the motor and is rotated by the frictional force with respect to the recording material conveying belt 151. However, it is also possible to independently provide motors to the recording material conveying belt 151 and the photosensitive drum 1. Further, these members can also be actuated by distributing thereto a driving force from a common motor. In the case of providing the motor for actuating the photosensitive drum 1, it is possible to use the image forming stations shown in FIG. 1.

Sixth Embodiment

In First to Fourth Embodiments, the reduction in relative friction between the photosensitive drum 1 and the intermediary transfer belt 51 is intended. As described above, when the photosensitive drum 1 has the OPC layer as the surface layer, i.e., is an organic photosensitive member, the OPC layer is liable to be damaged by the relative friction, so that the damaged surface layer adversely affects the toner image formed on the photosensitive drum 1 to lower an image quality. Similarly, the rubbing damage formed on the intermediary transfer belt 51 can also cause primary transfer non-uniformity and secondary transfer non-uniformity, thus resulting in a possibility of a lowering in image quality. Although a direct influence on the image is less, the rubbing damage formed on the recording material conveying belt 151 can contain the particles to worsen the rubbing damage on the photosensitive drum 1.

In this embodiment (Sixth Embodiment), with respect to rotatable members always contacting the intermediary transfer belt 51 or the recording material conveying belt 151, the voltage application control described in First to Fourth Embodiment is performed. During both of the start-up period for actuation and the speed-reducing rest period, a voltage is applied by using the voltage applying mechanism employed, so that an electrical attraction force is generated between the rotatable members and the intermediary transfer belt 51 or the recording material conveying belt 151. As a result, the press-contact force between these members is increased to enhance the frictional driving force to reduce the frequency of occurrences of the relative friction, so that the rubbing damage is less liable to be caused to occur.

As described above with reference to FIG. 1, the intermediary transfer belt 51 is formed of the PI resin material and the outer secondary transfer roller 57 is formed of the electroconductive EPDM rubber material. The outer secondary transfer roller 57 is rotated by contacting the intermediary transfer belt 51. In the case where the slip between the intermediary transfer belt 51 and the outer secondary transfer roller 57 is caused by an actuation torque of the outer secondary transfer roller 57 when the intermediary transfer belt 51 is actuated for rotation, an ion-type electroconductive agent or the like bled from the electroconductive EPDM rubber material of the outer secondary transfer roller 57 is attached to the surface of the intermediary transfer belt 51 formed of the PI resin material. A transfer property in an area in which the ion-type electroconductive agent or the like is attached is different from those in other areas, so that there arises a problem of an occurrence of density non-uniformity.

Therefore, in the image forming apparatus 100 of this embodiment, the control portion 90 controls the secondary transfer bias power source 50 so as to alleviate the slip between the outer secondary transfer roller 57 and the intermediary transfer belt (image carrying member) 51. The start-up and rest of these members are controlled by the control similarly as in First Embodiment (FIG. 3), Second Embodiment (FIG. 5), Third Embodiment (FIG. 6), or Fourth Embodiment (FIG. 7).

Incidentally, the outer secondary transfer roller 57 is not provided with the driving mechanism and is rotated by the intermediary transfer belt 51 through the friction force with the intermediary transfer belt 51. In this embodiment, to the outer secondary transfer roller 57, a voltage is applied from the secondary transfer bias power source 50 during the start-up and rest of the rotation of the intermediary transfer belt 51. As a result, the electrostatic attraction force between the intermediary transfer belt 51 and the outer secondary transfer roller 57 is increased, so that the frictional force can be increased so as to obviate the slip.

With respect to the voltage applied between the outer secondary transfer roller 57 and the inner secondary transfer roller 56 disposed opposite thereto, a polarity of the voltage is not limited. Further, either of these rollers may be grounded and supplied with the voltage.

In the case of employing a constitution in which the outer secondary transfer roller 57 is mountable and demountable, it is preferable that the voltage is applied by the above-described sequence after the outer secondary transfer roller 57 is brought into contact with the intermediary transfer belt 51 during the rotation start-up.

Seventh Embodiment

In this embodiment, with respect to the adsorption (attraction) roller 84 in the image forming apparatus 200 shown in FIG. 8, the slip between the adsorption roller (contact member) 84 and the recording material conveying belt (recording material carrying member) 151 is reduced by controlling the adsorption bias power source 95 by means of the control portion 190. The start-up and rest of rotation are controlled by the control similarly as in First Embodiment (FIG. 3), Second Embodiment (FIG. 5). Third Embodiment (FIG. 6) or Fourth Embodiment (FIG. 7).

In this embodiment, with respect to FIGS. 3, 6 and 7, the primary transfer roller reads the adsorption roller. Further, the voltage Vt1 in FIGS. 3, 6 and 7 reads a voltage (of +1000 V) applied to the adsorption roller 84 for attracting the recording material P to the recording material conveying belt 151. The voltage Vt0 shown in FIG. 6 reads a voltage (of +1300 V) higher (in terms of an absolute value) than the voltage applied to the adsorption roller 84 for attracting the recording material P to the recording material conveying belt 151. The voltage Vtr0 shown in FIG. 7 reads a voltage of a polarity opposite to that of the voltage applied to the adsorption roller 84 for attracting the recording material P to the recording material conveying belt 151.

As a result, the friction (rubbing) between the adsorption roller 84 and the recording material conveying belt 151 is obviated.

Figure 10:
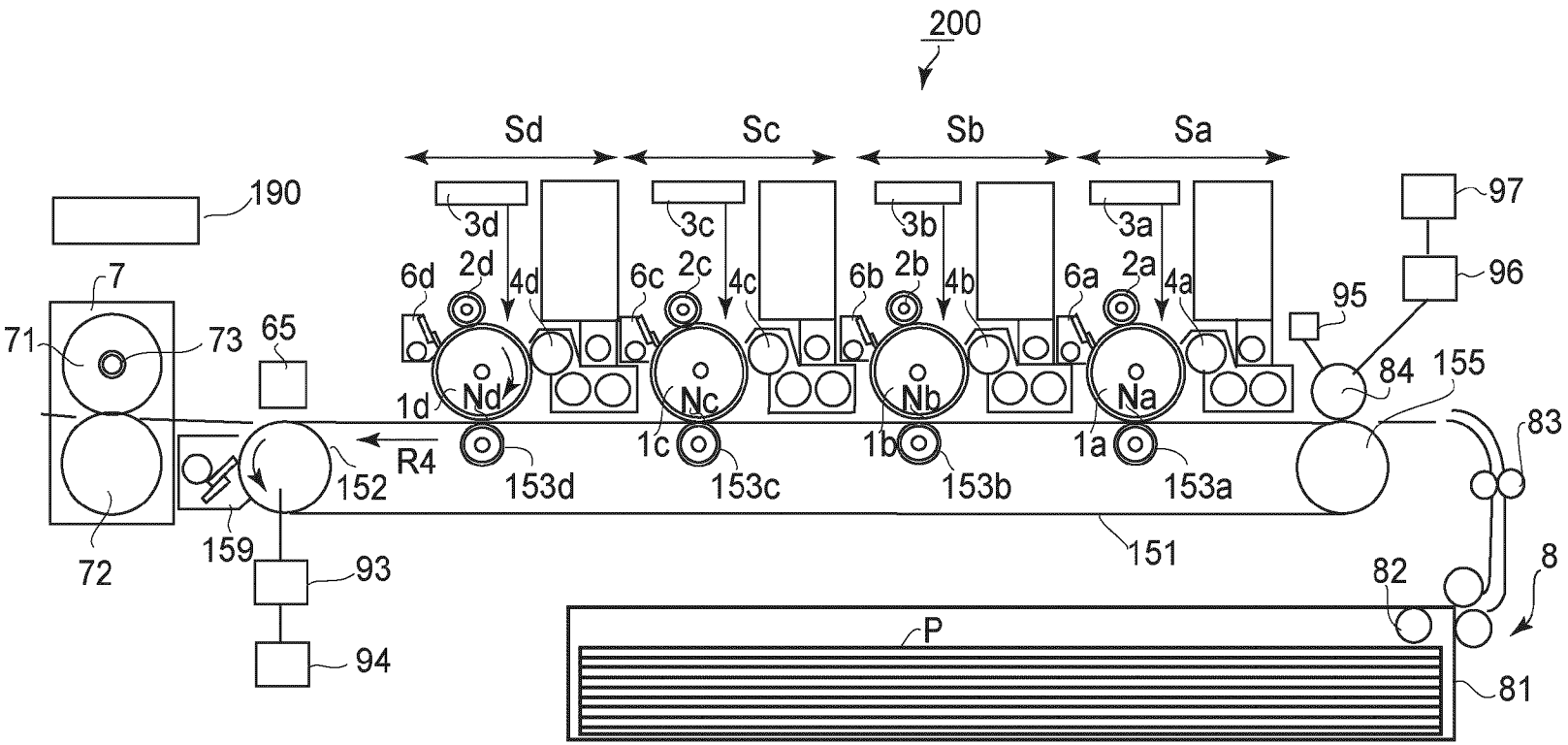
FIG. 10 is a schematic sectional view showing a modified embodiment of Fifth Embodiment.

Incidentally, the adsorption roller 84 is not provided with the driving mechanism and is rotated by the recording material conveying belt 151 through the frictional force with the recording material conveying belt 151. Further, the adsorption roller 84 can also be actuated by distributing the driving force of the driving roller motor 93. The adsorption roller can also be actuated by the adsorption roller motor 96 controlled by the adsorption roller motor control portion 97 as shown in FIG. 10.

With respect to the voltage applied between the adsorption roller 84 and the follower roller 155 disposed opposite thereto, a polarity of the voltage is not limited. Further, either of these rollers may be grounded and supplied with the voltage.

In the case of employing a constitution in which the adsorption roller 84 is mountable and demountable, it is preferable that the voltage is applied by the above-described sequence after the adsorption roller 84 is brought into contact with the recording material conveying belt 151 during the rotation start-up.

Further, with respect to members other than those described in Sixth and Seventh Embodiments, it is possible to alleviate the slip during the start-up and during the rest by utilizing the above-described voltage application sequences. Examples of the members may include the charging roller 2, the intermediary transfer drum, the cleaning roller, etc.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 341903/2006 filed Dec. 19, 2006, which is hereby incorporated by reference.

What is claimed is:

1. An image forming apparatus comprising:

a photosensitive member;

a charging member for electrically charging said photosensitive member to form a toner image on said photosensitive member;

a rotatable belt member for carrying the toner image;

a transfer member for transferring the toner image from said photosensitive member onto said belt member;

a voltage applying member for applying a voltage to said transfer member; and control means for effecting control so that a voltage is applied to said transfer member by said voltage applying member when said belt member and said photosensitive member are at rest and continues into a period when said belt member and said photosensitive member are rotating, wherein a polarity of the voltage is identical to a polarity of said charged photosensitive member, and is opposite to a polarity of a transfer voltage for transferring the toner image from said photosensitive member onto said belt member.

2. An apparatus according to claim 1, wherein said photosensitive member and said belt member are supplied with a driving force from independent driving means, respectively.

3. An apparatus according to claim 1, wherein said photosensitive member and said belt member are supplied with a driving force from common driving means.

4. An apparatus according to claim 1, wherein said photosensitive member is rotated by the rotation of said belt member.

5. An image forming apparatus comprising:

a photosensitive member;

a charging member for electrically charging said photosensitive member to form a toner image on said photosensitive member;

a rotatable belt member for carrying the toner image;

a transfer member for transferring the toner image from said photosensitive member onto said belt member;

a voltage applying member for applying a voltage to said transfer member; and control means for effecting control so that a voltage is applied to said transfer member by said voltage applying member when said belt member and said photosensitive member are rotating and continues into a period when said belt member and said photosensitive member are at rest, wherein a polarity of the voltage is identical to a polarity of said charged photosensitive member, and is opposite to a polarity of a transfer voltage for transferring the toner image from said photosensitive member onto said belt member.

6. An apparatus according to claim 5, wherein said photosensitive member and said belt member are supplied with a driving force from independent driving means, respectively.

7. An apparatus according to claim 5, wherein said photosensitive member and said belt member are supplied with a driving force from common driving means.

8. An apparatus according to claim 5, wherein said photosensitive member is rotated by the rotation of said belt member.

9. An image forming apparatus comprising:

a photosensitive member;

a charging member for electrically charging said photosensitive member to form a toner image on said photosensitive member;

a rotatable belt member for carrying a recording material onto which the toner image is to be transferred;

a transfer member for transferring the toner image from said photosensitive member onto the recording material carried on said belt member;

a voltage applying member for applying a voltage to said transfer member; and control means for effecting control so that a voltage is applied to said transfer member by said voltage applying member when said belt member and said photosensitive member are at rest and continues into a period when said belt member and said photosensitive member are rotating, wherein a polarity of the voltage is identical to a polarity of said charged photosensitive member, and is opposite to a polarity of a transfer voltage for transferring the toner image from said photosensitive member onto the recording material.

10. An apparatus according to claim 9, wherein said photosensitive member and said belt member are supplied with a driving force from independent driving means, respectively.

11. An apparatus according to claim 9, wherein said photosensitive member and said belt member are supplied with a driving force from common driving means.

12. An apparatus according to claim 9, wherein said photosensitive member is rotated by the rotation of said belt member.

13. An image forming apparatus comprising:

a photosensitive member;

a charging member for electrically charging said photosensitive member to form a toner image on said photosensitive member;

a rotatable belt member for carrying a recording material onto which the toner image is to be transferred;

a transfer member for transferring the toner image from said photosensitive member onto the recording material carried on said belt member;

a voltage applying member for applying a voltage to said transfer member; and control means for effecting control so that a voltage is applied to said transfer member by said voltage applying member when said belt member and said photosensitive member are rotating and continues into a period when said belt member and said photosensitive member are at rest, wherein a polarity of the voltage is identical to a polarity of said charged photosensitive member, and is opposite to a polarity of a transfer voltage for transferring the toner image from said photosensitive member onto the recording material.

14. An apparatus according to claim 13, wherein said photosensitive member and said belt member are supplied with a driving force from independent driving means, respectively.

15. An apparatus according to claim 13, wherein said photosensitive member and said belt member are supplied with a driving force from common driving means.

16. An apparatus according to claim 13, wherein said photosensitive member is rotated by the rotation of said belt member.

17. An image forming apparatus comprising:

a photosensitive member;

a charging member for electrically charging said photosensitive member to form a toner image on said photosensitive member;

a rotatable belt member for carrying the toner image;

a transfer member for transferring the toner image from said photosensitive member onto said belt member;

electric field forming means for forming an electric field between said belt member and said photosensitive member by applying a voltage; and control means for effecting control so that an electric field is formed between said belt member and said photosensitive member by said electric field forming means when said belt member and said photosensitive member are at rest and continues into a period when said belt member and said photosensitive member are rotating, wherein the electric field is formed so that the polarity thereof at a belt member side is identical to a polarity of said charged photosensitive member, and a direction of the electric field is opposite to a direction for transferring the toner image from said photosensitive member onto said belt member.

18. An apparatus according to claim 17, wherein said photosensitive member and said belt member are supplied with a driving force from independent driving means, respectively.

19. An apparatus according to claim 17, wherein said photosensitive member and said belt member are supplied with a driving force from common driving means.

20. An apparatus according to claim 17, wherein said photosensitive member is rotated by the rotation of said belt member.

21. An image forming apparatus comprising:

a photosensitive member;

a charging member for electrically charging said photosensitive member to form a toner image on said photosensitive member;

a rotatable belt member for carrying the toner image;

a transfer member for transferring the toner image from said photosensitive member onto said belt member;

electric field forming means for forming an electric field between said belt member and said photosensitive member by applying a voltage; and control means for effecting control so that an electric field is formed between said belt member and said photosensitive member by said electric field forming means when said belt member and said photosensitive member are rotating and continues into a period when said belt member and said photosensitive member are at rest, wherein the electric field is formed so that the polarity thereof at a belt member side is identical to a polarity of said charged photosensitive member, and a direction of the electric field is opposite to a direction for transferring the toner image from said photosensitive member onto said belt member.

22. An apparatus according to claim 21, wherein said photosensitive member and said belt member are supplied with a driving force from independent driving means, respectively.

23. An apparatus according to claim 21, wherein said photosensitive member and said belt member are supplied with a driving force from common driving means.

24. An apparatus according to claim 21, wherein said photosensitive member is rotated by the rotation of said belt member.

* * * * *